US009441512B1

(12) United States Patent
Collareno et al.

(10) Patent No.: US 9,441,512 B1
(45) Date of Patent: Sep. 13, 2016

(54) MUFFLER SHELL BODY WITH INTEGRAL AERODYNAMIC SHIELD

(71) Applicant: FORD GLOBAL TECHNOLOGIES, LLC, Dearborn, MI (US)

(72) Inventors: Michael D. Collareno, Northville, MI (US); Erich James Nowka, Ann Arbor, MI (US); Kerry Timothy Havener, Canton, MI (US); Steven A. Hornby, Ypsilanti, MI (US)

(73) Assignee: FORD GLOBAL TECHNOLOGIES, LLC, Dearborn, MI (US)

( * ) Notice: Subject to any disclaimer, the term of this patent is extended or adjusted under 35 U.S.C. 154(b) by 0 days.

(21) Appl. No.: 14/808,036

(22) Filed: Jul. 24, 2015

(51) Int. Cl.
*F01N 13/08* (2010.01)
*F01N 13/18* (2010.01)
*F01N 1/08* (2006.01)

(52) U.S. Cl.
CPC ..... *F01N 1/084* (2013.01); *F01N 13/1844* (2013.01)

(58) Field of Classification Search
CPC ..... F01N 13/1844; F01N 13/082; F01N 2260/022
USPC ..... 181/227, 228, 282
See application file for complete search history.

(56) References Cited

U.S. PATENT DOCUMENTS

| | | | | |
|---|---|---|---|---|
| 3,479,725 | A | 11/1969 | Shaff et al. | |
| 7,293,628 | B2 | 11/2007 | Takahashi | |
| 7,549,508 | B2 * | 6/2009 | Okawara | F01N 1/084 181/212 |
| 7,740,105 | B2 * | 6/2010 | Kimata | F01N 3/005 181/212 |
| 2007/0271788 | A1 | 11/2007 | Tsekrekos et al. | |
| 2009/0314750 | A1 * | 12/2009 | Saitoh | B23K 26/0876 219/121.64 |
| 2014/0251241 | A1 * | 9/2014 | Tajima | B60K 11/04 123/41.56 |

FOREIGN PATENT DOCUMENTS

| | | | |
|---|---|---|---|
| DE | 102008024786 | A1 | 11/2009 |
| JP | 2002206422 | A | 7/2002 |
| JP | 2003113714 | A | 4/2003 |
| JP | 2012241639 | A | 12/2012 |
| KR | 20130061580 | | 6/2013 |

* cited by examiner

*Primary Examiner* — Jeremy Luks
(74) *Attorney, Agent, or Firm* — James Dottavio; MacMillan, Sobanski & Todd, LLC

(57) ABSTRACT

A muffler shell is formed from a sheet metal blank. The shell comprises a tubular body section which is rolled into a tube so that a first edge of the blank can be welded to an intermediate seam line across the blank. An aerodynamic shield extension projects integrally from the tubular body section between the intermediate seam line and a second edge of the blank to cover a gap between the muffler and adjacent structures when installed on a vehicle.

21 Claims, 5 Drawing Sheets

MUFFLER SHELL BODY WITH INTEGRAL AERODYNAMIC SHIELD

CROSS REFERENCE TO RELATED APPLICATIONS

Not Applicable.

STATEMENT REGARDING FEDERALLY SPONSORED RESEARCH

Not Applicable.

BACKGROUND OF THE INVENTION

The present invention relates in general to mufflers for the exhaust system of vehicles with internal combustion engines, and, more specifically, to manufacturing a muffler shell from a sheet metal blank.

In the mass production of mufflers for the exhaust systems of motor vehicles and the like, a construction based on an outer, tubular shell made from sheet metal is commonly used due to advantages of low material cost and the availability of automated manufacturing processes and equipment. After forming the tubular shell, the addition of internal baffles, pipes, and end caps completes the muffler.

When installed into a vehicle such as a car or truck, a bottom side of the muffler is typically exposed to an open space beneath the vehicle. During vehicle movement, a high velocity air flow beneath the vehicle can interact with the muffler and any gaps, connecting structures, or protective liners/shields spaced from or surrounding the muffler. The interaction can create undesirable turbulence that affects vehicle performance and increases noise in the passenger cabin. The interaction can be especially pronounced when the muffler is mounted transversely to the direction of vehicle travel.

Applicant's co-pending U.S. application Ser. No. 14/549,188, filed Nov. 20, 2014, entitled "Muffler Shield and Muffler Assembly Employing the Same" (which is incorporated herein by reference in its entirety), discloses the addition of an aerodynamic shield to occupy a gap adjacent the muffler. In particular, a separate aerodynamic form is fabricated and then is attached to the outside surface of the muffler body. However, the separate fabrication and attachment of an aerodynamic shield structure to fill a gap around the muffler results in increased cost and manufacturing complexity.

SUMMARY OF THE INVENTION

In one aspect of the invention, a muffler shell is formed by a plate of sheet metal. The shell comprises a tubular body section wherein a first edge of the plate is welded to an intermediate seam line across the plate. An aerodynamic shield extension projects integrally from the tubular body section between the intermediate seam line and a second edge of the plate.

The plate is preferably a sheet metal blank, and various features may be provided on the shield extension using various manufacturing processes including stamping, punching, bending, folding, and rolling, such as the formation of stamped ribs to add stiffness to the shield extension. Rolling may preferably be used to then form the remainder of the blank into the tubular body section. Finally, a damping link may be formed between the shield extension and the outer surface of the body section (spaced away from the seam line) to reduce shield vibrations.

In a preferred method of the invention, a muffler is manufactured from a sheet metal blank. An aerodynamic shield is shaped adjacent a first end of the blank. A portion of the blank is rolled from a second end of the blank opposite the first end until the second end is proximate an intermediate seam line. The second end is welded to the blank along the seam line to establish a tubular body section, wherein the aerodynamic shield integrally extends from the body section. Then end caps are joined to tubular ends of the body section.

DETAILED DESCRIPTION OF PREFERRED EMBODIMENTS

Figure 1:
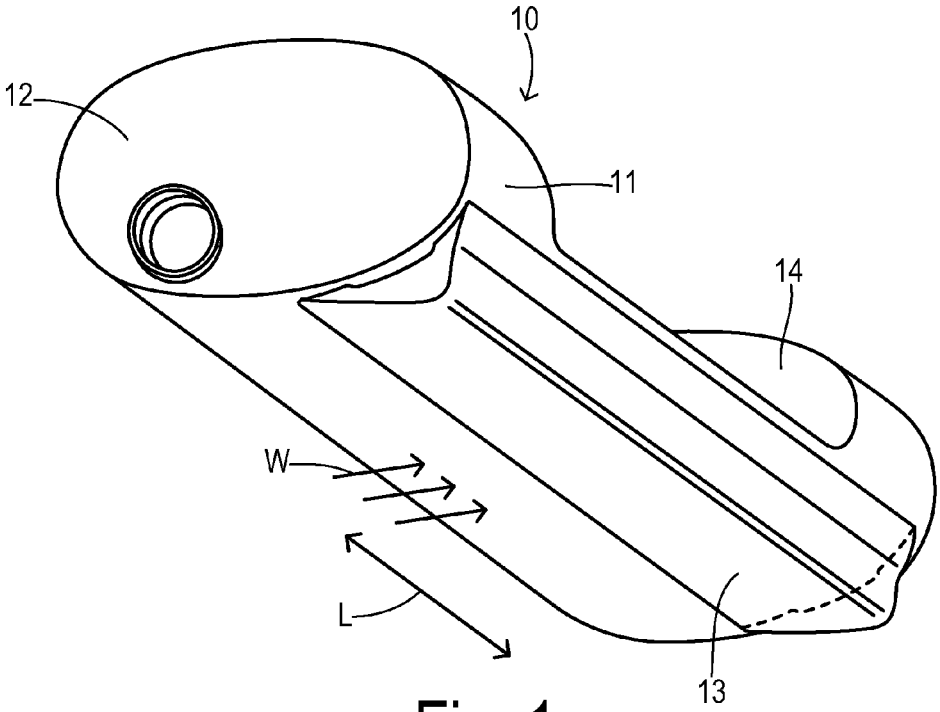
FIG. 1 is a perspective view of a muffler with a separately formed aerodynamic shield.

Referring to FIG. 1, a muffler assembly 10 includes a shell 11 with a tubular shape to receive end caps, including an end cap 12. Muffler assembly 10 extends generally in a longitudinal direction L, and when mounted transversely in a vehicle then a wind W flows over muffler assembly 10. During forward travel of the vehicle, the direction of wind W is transverse to longitudinal direction L. To reduce turbulence created by wind W in a gap between the muffler assembly 10 and adjacent structures in the vehicle, a separate shield body 13 has been suggested in the co-pending application mentioned above. Shield 13 is attached to the outer surface of muffler shell 11 as shown. Muffler assembly 10 may preferably have a generally elliptical cross-section, but may also include a conformal depression 14 to accommodate other vehicle components, such as a space for a spare tire, as known in the art.

Figure 2:
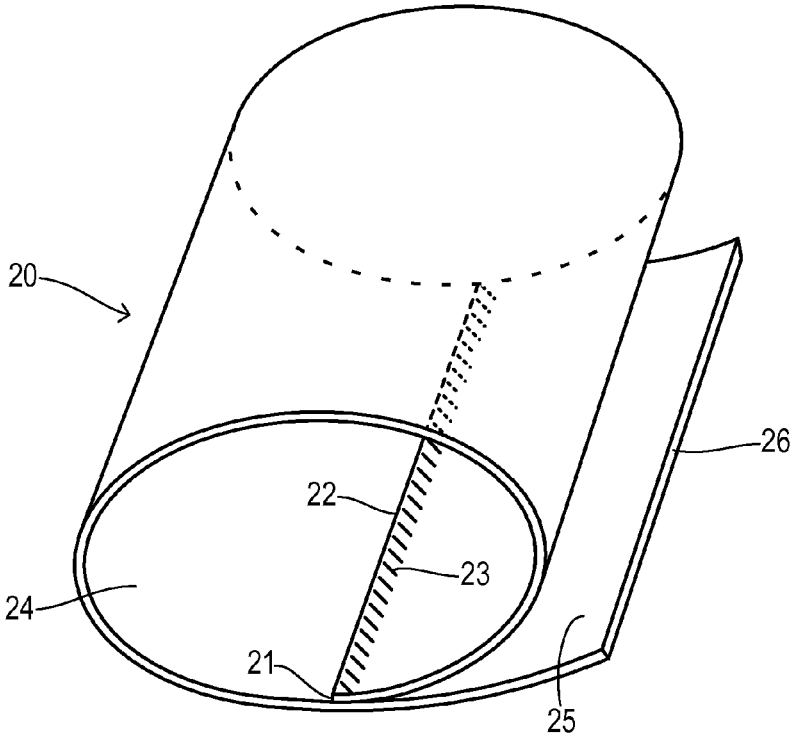
FIG. 2 is a perspective view of a rolled muffler shell with an integral shield extension according to a first embodiment.

Since shield body 13 is a separately manufactured component, it requires separate handling and additional manufacturing processes in order to attach it to an outer surface of muffler assembly 10. To overcome these disadvantages, the present invention adapts the manufacturing process of forming a rolled muffler shell body in order to create an integral aerodynamic shield as shown in FIG. 2. Thus, a sheet-metal plate 20 is partially rolled so that a first edge 21 of the plate is aligned with an intermediate seam line 22 extending across the plate. Edge 21 is joined to a central portion of plate 20 by a weld 23 along seam line 22 resulting in a tubular body section 24 with an aerodynamic shield extension 25 projecting integrally from body section 24 between seam line 22 and a second edge 26 of the plate. End caps (not shown) can then be added to the open ends of tubular body section 24 resulting in a muffler assembly with an integral aerodynamic shield avoiding the separate manufacturing, handling, and mounting of a separate shield.

Figure 3:
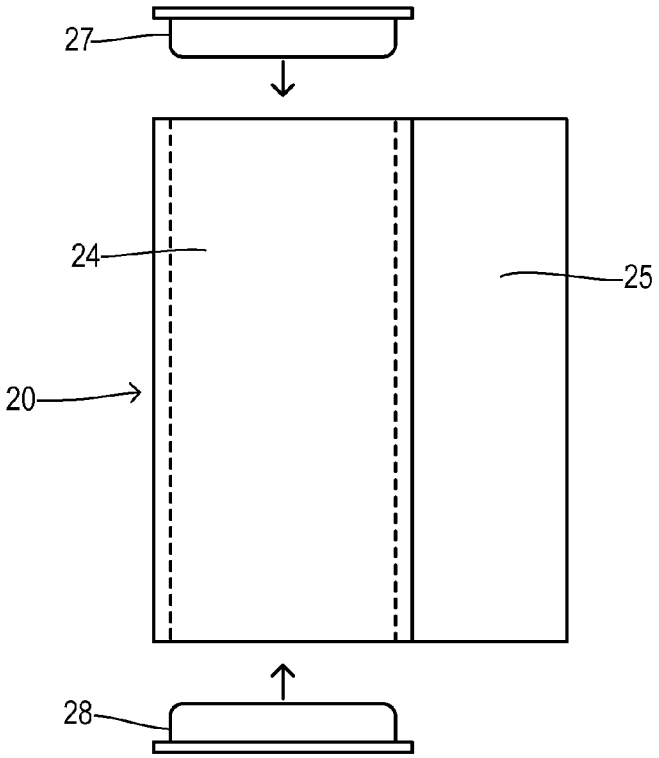
FIG. 3 is a top view of the muffler shell of FIG. 2 with end caps.

FIG. 3 is a top view of shell 20 illustrating the addition of end caps 27 and 28. In this embodiment, end caps 27 and 28 are formed as male plug elements for being inserted into the open ends of tubular body section 24, thereby avoiding any interference with aerodynamic shield extension 25.

Figure 4A:
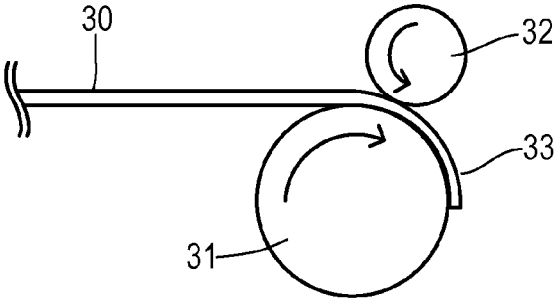
FIGS. 4A-4E show a sequence of rolling, welding, and bending of a metal blank to form a muffler shell.
Figure 4B:
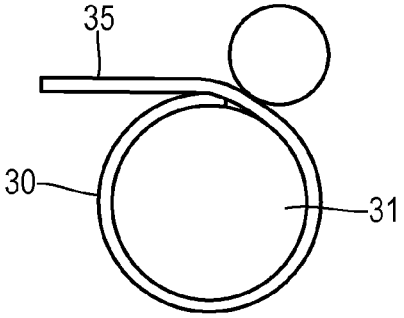
Figure 4C:
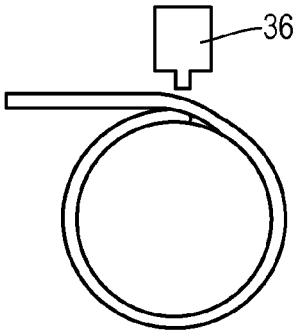

FIGS. 4A-4E illustrate typical manufacturing steps for processing a muffler shell of the invention. In FIG. 4A, a sheet metal blank 30 is coiled over a mandrel/roller 31 by a roller 32. As blank 30 passes between rollers 31 and 32, a curved portion 33 is gradually formed. After one full rotation of mandrel 31, metal blank 30 forms a continuous loop together with an unrolled extension 35. Having reached this configuration, one edge of the blank is now proximate to an intermediate seam line. In FIG. 4C, a welder 36 is placed proximate the seam and is energized to create a weld (e.g., a fillet weld), thereby sealing the tubular body section. Alternatively, welding can be performed after removing the rolled blank from the mandrel/rolling machine in order to access the interior of the tubular body section for welding it from the inside.

Figure 4D:
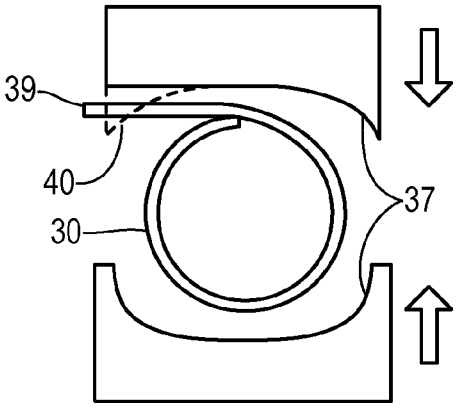
Figure 4E:
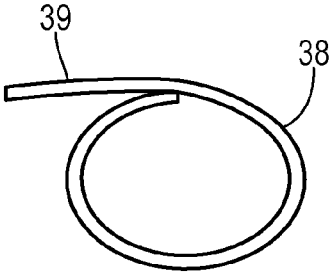

Since an elliptical cross-section is typically desired for the finished muffler, the rolled blank having a circular cross-section may be placed in a press as shown in FIG. 4D. The press has appropriately shaped tool surfaces 37 for compressing rolled blank 38 to give it an elliptical shape as shown in FIG. 4E. It is also possible to simultaneously modify the shape of an aerodynamic shield extension 39 using an optional extension 40 on the tool surface. Alternatively, shaping of the aerodynamic shield extension may be performed prior to bending of the body section as is described below.

Figure 5:
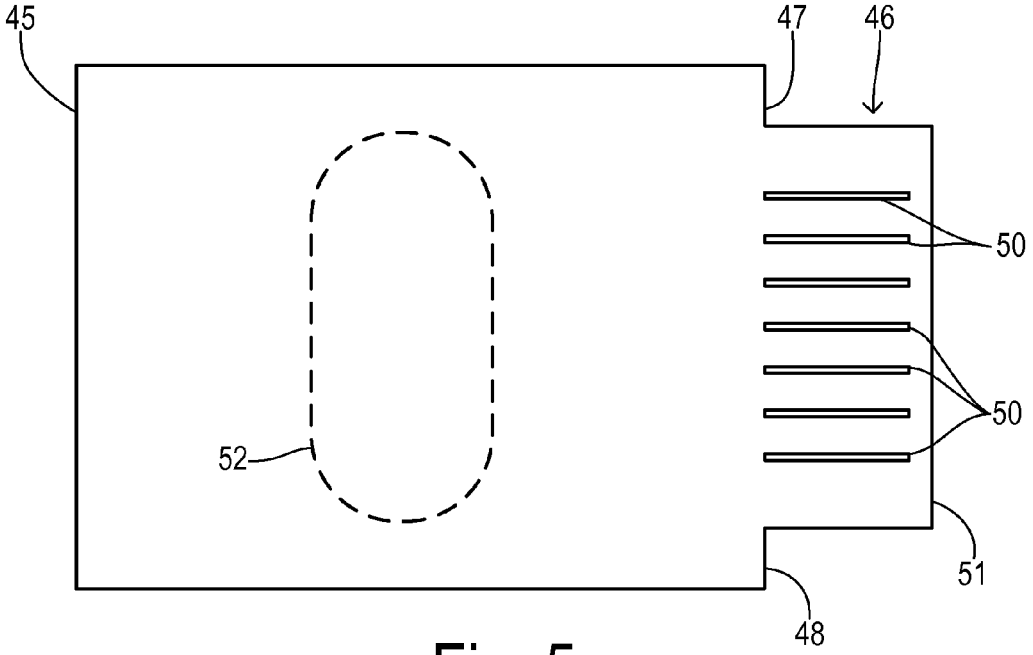
FIG. 5 is a top view of a metal blank according to another embodiment wherein additional stamping and cutting provide additional shield features prior to rolling of the body section.

FIG. 5 shows a sheet metal blank 45 which has been pre-processed to add various features before the rolling of the tubular body section. In particular, one end of blank 45 is modified to provide various features on the shield extension. In particular, a shield extension portion 46 may include notched edges 47 and 48 to provide space at the longitudinal ends of the tubular body section for receiving female end caps (discussed below in connection with FIG. 6). Notches 47 and 48 may be formed by punching or cutting, for example. In addition, the stiffness of shield extension portion 46 can be increased by adding stamped ribs 50. Ribs 50 preferably extend perpendicular to an edge 51 of blank 45. A dashed line 52 shows a location for introducing a central depression (either before or after rolling of the body section) to create the conformal section at the top of the muffler assembly that varies from the tubular cross-section. While a squared profile is shown for the shield in FIG. 5, the edges may preferably be rounded or have other profiles for optimally filling surrounding gaps to minimize aerodynamic drag.

Figure 6:
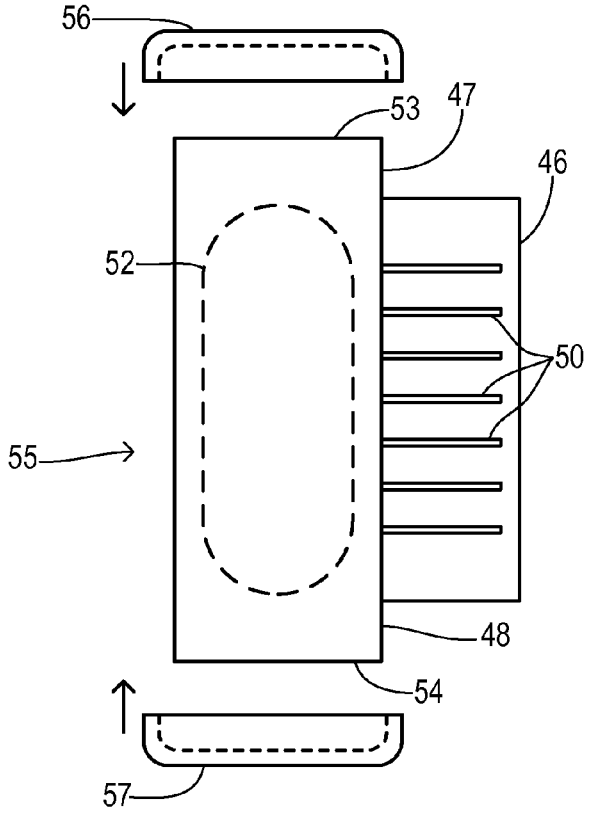
FIG. 6 is a top view of the metal blank of FIG. 5 after rolling of the body section and showing end caps.

After rolling and welding of the tubular body section, a muffler shell 55 shown in FIG. 6 is created with shield extension 46 spaced away from longitudinal ends 53 and 54 in order to accommodate the placement of end caps 56 and 57. End caps 56 and 57 may preferably be formed as stamped metal blanks which are attached to the rolled muffler shell by welding or using a rolled crimp as known in the art.

Figure 7:
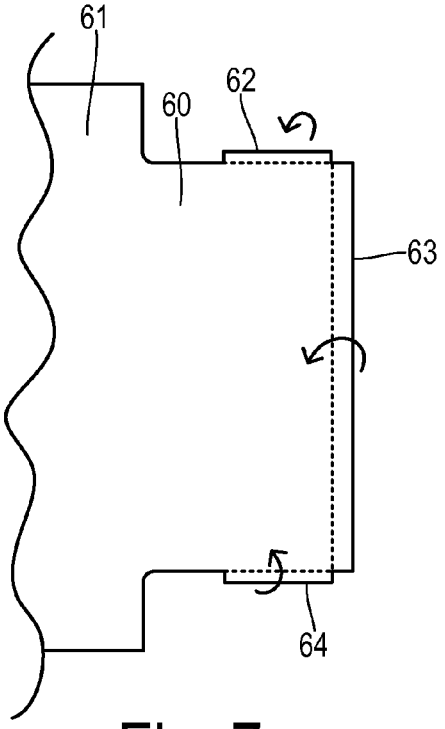
FIG. 7 is a top view of a metal blank showing hemming along edges of the aerodynamic shield.

The edges of the shield extension may preferably be crimped or hemmed to avoid a sharp edge and to provide additional stiffness. As shown in FIG. 7, a shield extension 60 projecting from a body section 61 includes edge tabs 62, 63, and 64 extending along respective edges can be folded over by 180° along the dashed lines in order to provide a hem. Tabs 62-64 can be formed during a stamping operation that cuts the notches that reduced the width of shield extension 60, for example. A known folding or wiping operation can be used in order to produce the hem folds.

Figure 8:
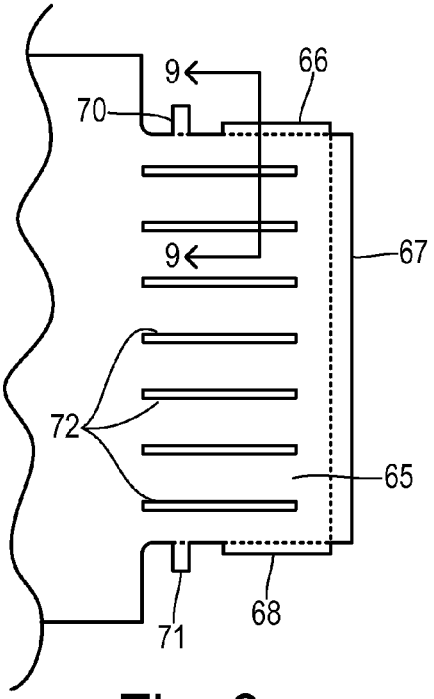
FIG. 8 is a top view of a metal blank showing stamped ribs and edge features for forming hems and gussets on the aerodynamic shield.
Figure 9:
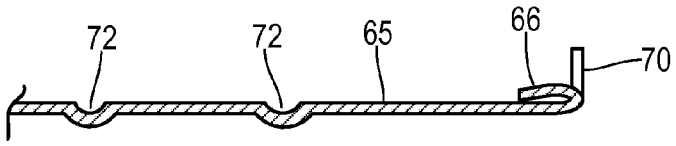
FIG. 9 is a cross section of the shield along line 9-9 in FIG. 8.

FIG. 8 shows a further embodiment wherein a shield extension 65 includes hem tabs 66, 67, and 68. Shield 65 further includes gusset tabs 70 and 71 and a plurality of stiffening ribs 72. The hem tabs, gusset tabs, and stiffening ribs may all be formed during a single stamping operation. Gusset tabs 70 and 71 are folded to a 90° angle as known in the art to provide added stiffness for shield extension 65. FIG. 9 shows a cross-sectional view through shield extension 65 after performing folding operations wherein hem tab 66 has been folded over by about 180° and gusset tab 70 has been folded upward by about 90°. Gusset tabs 70 and 71 can also be incorporated with hem tabs 66 and/or 68, for example. Furthermore, ribs 72 could have other arrangements such as crossing patterns or other embossed features (dimps and dents).

Since the shield extension is cantilevered from the weld seam with the body section of the muffler shell, additional reinforcement for the shield extension may be desired. A cantilevered shield extension may experience undesirable vibrations which can be reduced by adding a damping link between the shield extension and the body section (provided the damping link is spaced away from the intermediate seam line). The damping link reinforces the shield extension and reduces its ability to vibrate at lower frequencies.

Figure 10:
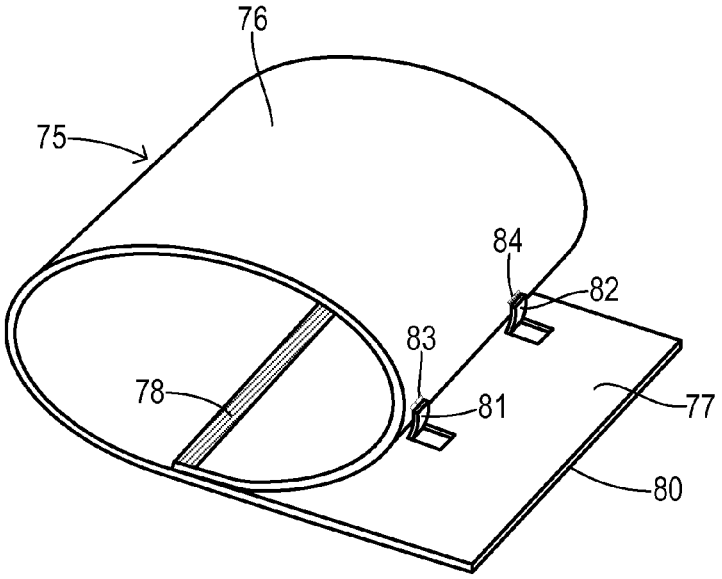
FIG. 10 is a perspective view of a muffler shell with cutaway tabs linking the shield to the body section.

FIG. 10 shows a first damping arrangement wherein a muffler shell 75 includes a tubular body section 76 and an aerodynamic shield extension 77 projecting from a weld seam line 78. Between seam line 78 and an edge 80 of shield extension 77, a damping link is formed using cutaway tabs 81 and 82 which are folded up from a central region of shield extension 77 in order to be attached to an outer surface of body section 76 by welds 83 and 84. Cutaway tabs 81 and 82 may be formed by a punching operation.

Figure 11:
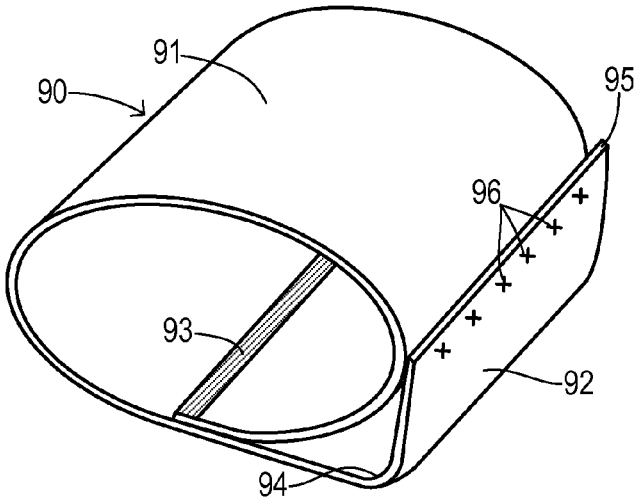
FIG. 11 is a perspective view of a muffler shell with a bend in the shield for joining an outside edge of the shield to the body section.

FIG. 11 shows another embodiment wherein a muffler shell 90 has a tubular body section 91 welded to a shield extension 92 along seam line 93. Shield extension 94 includes a bend 94 which causes an edge 95 of shield extension 92 to become juxtaposed with an outer surface of body section 91. To form the damping link, a series of spot welds 96 join edge 95 to body section 91.

Separate add-on elements (such as braces, struts, gusset pieces, or stamped bosses) could also be used for stiffening the shield extension and/or for providing damping links between the shield extension and the outer surface of the body section. Furthermore, various aerodynamic shapes can be utilized for the shield extension. The size, shape, and curvature for the shield extension can be adjusted in order to match the gap to be closed for any particular vehicle design.

What is claimed is:

1. A muffler shell formed by a plate of sheet metal, comprising:

a tubular body section wherein a first edge of the plate is welded to an intermediate seam line across the plate; and an aerodynamic shield extension projecting integrally from the tubular body section between the intermediate seam line and a second edge of the plate, the aerodynamic shield extension directing transverse air flow away from the tubular body section.

2. The muffler shell of claim 1 wherein the shield extension is notched proximate the intermediate seam line to provide a reduced lateral width of the shield extension for accommodating end caps at tubular ends of the body section.

3. The muffler shell of claim 1 wherein the shield extension has at least one edge including a hem formed by folding over the at least one edge.

4. The muffler shell of claim 1 wherein the shield extension includes a gusset comprised of an external tab extending from an edge of the shield extension via a transverse fold.

5. The muffler shell of claim 1 further comprising a damping link between the shield extension and the body section, wherein the damping link is spaced from the intermediate seam line.

6. The muffler shell of claim 5 wherein the shield extension includes a bend juxtaposing the second edge of the plate with the body section, and wherein the damping link comprises a weld between the second edge and the body section.

7. The muffler shell of claim 5 wherein the shield extension includes an internal cutaway tab bent toward the body section, and wherein the damping link comprises a weld between the cutaway tab and the body section.

8. A muffler comprising:

a sheet metal blank formed into a tubular body section and an aerodynamic shield extension, wherein a first edge of the blank is welded to an intermediate seam line across the blank to close the body section, wherein the shield extension projects integrally from the body section between the seam line and a second edge of the blank, and wherein at least a portion of the aerodynamic shield extension is non-contacting with the tubular body section; and end caps joined to tubular ends of the body section.

9. The muffler of claim 8 wherein the shield extension is notched proximate the intermediate seam line to provide a reduced lateral width of the shield extension for accommodating the end caps.

10. The muffler of claim 8 wherein the shield extension comprises stamped ribs extending perpendicular to the second edge of the blank.

11. The muffler of claim 8 wherein the shield extension has at least one edge including a hem formed by folding over the at least one edge.

12. The muffler of claim 8 wherein the shield extension includes a gusset comprised of an external tab extending from an edge of the shield extension via a transverse fold.

13. The muffler of claim 8 wherein the shield extension includes a bend juxtaposing the second edge of the blank with the body section, and wherein the muffler further comprises a weld between the second edge and the body section.

14. The muffler of claim 8 wherein the shield extension includes an internal cutaway tab bent toward and welded to the body section.

15. A method of manufacturing a muffler from a sheet metal blank, comprising the steps of:

shaping an aerodynamic shield adjacent a first end of the blank;

rolling a portion of the blank from a second end of the blank opposite the first end until the second end is proximate an intermediate seam line;

welding the second end to the blank along the seam line to establish a tubular body section, wherein the aerodynamic shield integrally extends from the body section to direct transverse air flow away from the body section; and joining end caps to tubular ends of the body section.

16. The method of claim 15 wherein shaping the aerodynamic shield is comprised of stamping of ribs into the shield to add stiffness.

17. The method of claim 15 wherein shaping the aerodynamic shield is comprised of bending to form at least one of a hem or a gusset.

18. The method of claim 15 further comprising the step of forming a damping connection between the aerodynamic shield and the body section remote from the seam line.

19. The method of claim 15 further comprising the step of notching the blank at the first end to provide a reduced lateral width of the aerodynamic shield for accommodating the end caps.

20. A muffler shell formed by a plate of sheet metal, comprising:

a tubular body section wherein a first edge of the plate is welded to an intermediate seam line across the plate; and an aerodynamic shield extension projecting integrally from the tubular body section between the intermediate seam line and a second edge of the plate, wherein the shield extension comprises stamped ribs adding stiffness to the shield extension.

21. The muffler shell of claim 20 wherein the stamped ribs include a plurality of ribs extending perpendicular to the second edge of the plate.

* * * * *